US006622702B2

(12) United States Patent
Yomogida et al.

(10) Patent No.: US 6,622,702 B2
(45) Date of Patent: Sep. 23, 2003

(54) COMMON RAIL FUEL INJECTION DEVICE

(75) Inventors: Koichiro Yomogida, Fujisawa (JP); Kazutaka Ohishi, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 94 days.

(21) Appl. No.: 09/964,105

(22) Filed: Sep. 25, 2001

(65) Prior Publication Data

US 2003/0056761 A1 Mar. 27, 2003

(51) Int. Cl.[7] ..... F02M 47/00; F02M 55/00

(52) U.S. Cl. ..... 123/478; 123/490; 123/491; 123/456; 123/459

(58) Field of Search ..... 123/456, 459, 123/467, 478, 490, 491, 506; 239/87, 88, 96, 533.2, 585.1, 585.5

(56) References Cited

U.S. PATENT DOCUMENTS

| | | | | | |
|---|---|---|---|---|---|
| 6,053,150 | A | * | 4/2000 | Takahashi et al. | 123/501 |
| 6,055,962 | A | * | 5/2000 | Kirk | 123/516 |
| 6,192,864 | B1 | * | 2/2001 | Nishimura | 123/458 |
| 6,250,285 | B1 | * | 6/2001 | Takase | 123/456 |
| 6,257,203 | B1 | * | 7/2001 | Lei | 123/446 |
| 6,273,067 | B1 | * | 8/2001 | Bazinet | 123/458 |
| 6,345,606 | B1 | * | 2/2002 | Ricci-Ottati et al. | 123/456 |
| 6,481,411 | B1 | * | 11/2002 | Katayama | 123/339.23 |

FOREIGN PATENT DOCUMENTS

| | | | | |
|---|---|---|---|---|
| JP | 204955 | * | 10/1985 | F02M/37/06 |
| JP | 47190 | * | 2/1988 | F02M/37/00 |
| JP | 404234563 | * | 8/1992 | F02M/59/44 |
| JP | 06-129325 | | 5/1994 | F02M/55/00 |
| JP | 08-193551 | | 7/1996 | F02M/37/20 |
| JP | 54319 | * | 2/1998 | F02M/37/00 |
| JP | 263191 | * | 9/2001 | F02M/47/00 |

* cited by examiner

*Primary Examiner*—Hieu T. Vo
*Assistant Examiner*—Hai H Huynh
(74) *Attorney, Agent, or Firm*—McCormick, Paulding & Huber LLP

(57) ABSTRACT

When common rail pressure Pr is predetermined pressure Prai, which is low such that it is lower than the pressure for the initiation of fuel injection by the injectors (step 1), air-extraction pulse width Pwai, which is elected in accordance with a fixed value or the engine rotation speed (step 6), is elected as the final pulse width Pwf (step 7). Also, since air that is entrained with fuel is discharged at low pressure, along with fuel, from the pressure control chamber of the injectors, via a open/close valve, which opens based on pulse width Pwai, and via a discharge path, it is possible to avoid the effect, on the combustion characteristic, that arises due to the injection of entrained air, along with fuel, from nozzle holes into the combustion chamber.

20 Claims, 4 Drawing Sheets

COMMON RAIL FUEL INJECTION DEVICE

CROSS REFERENCES TO RELATED APPLICATIONS

This application corresponds to Japanese Patent Application No. 2000-070310 filed in JPO on Mar. 14, 2000, the entire disclosure of which is incorporated herein by reference.

BACKGROUND OF THE INVENTION

1. Field of the Invention

The present invention relates to a common rail fuel injection device for injecting fuel, which is stored in common rails under accumulated pressure, from injectors.

2. Description of the Related Art

Conventionally, with regard to engine fuel injection, in attempting to perform fuel injection at higher pressure, common rail fuel injection systems are known as a method of providing optimum control, in accordance with the running state of the engine, of conditions, for the injection of fuel from injectors, such as the timing of fuel injection and the amount of fuel injected. A common rail fuel injection system is one in which working fluid, to which a predetermined pressure has been applied by a fuel supply pump, is stored under accumulated pressure in common rails, and in which, based on the action of pressure of this working fluid, fuel is injected, into a combustion chamber from injectors respectively arranged in a plurality of cylinders, under optimum fuel injection conditions such as the fuel injection amount and the duration of the fuel injection, these conditions being determined by a controller in accordance with the engine running state. Each of these injectors comprises a control valve for performing control such that fuel supplied via a fuel supply pipe is allowed to pass or blocked.

When the working fluid is the fuel itself, the common rails store the fuel under accumulated pressure, and inside a fuel flow pass, which runs from the common rails, via a fuel supply pipe, to nozzle holes, which are formed in the front ends of the injectors, is continually subjected to the action of a fuel pressure that is suited to the injection pressure. In order to perform fuel injection over only a predetermined duration, the injectors comprise a open/close valve that constitutes a control valve and opens and closes the fuel flow pass, this open/close valve being actuated by an actuator, such as an electromagnetic actuator, or an actuator with magnetic bending elements. The controller controls the common rail pressure and the actuation of the injector open/close valves such that the pressurized fuel in the injectors is injected under fuel injection conditions that are optimum for the engine running state.

In a common rail fuel injection device, the open/close valves are actuated by actuators by means of electrical signals output by the controller. With regard to the fuel injection quantity, the controller determines a target Fuel injection quantity in accordance with the engine running state, and controls the duration over which the injector actuators are actuated in accordance with this target fuel injection quantity. When the actuators used are electromagnetic valves, the duration over which the electromagnetic valves are open, in other words, the pulse duration of a command pulse, for fuel injection, which is output by the controller to the electromagnetic valves, is controlled. However, the quantity of fuel injected in any given single period, in other words, the fuel injection rate, depends not only on the pulse duration but also on the fuel pressure of the common rails. Consequently, the pulse duration is elected in accordance with the target fuel injection quantity and this common rail fuel pressure.

An overview of a common rail fuel injection system, in which a common rail type fuel injection system is applied, is shown in FIG. 3. The common rail fuel injection system 1 shown in FIG. 3 is a system for a six-cylinder engine. The fuel in a fuel tank 4 passes through a pre-filter 5, and a filter 6, which comprises a circulation valve and a water separator, whereupon the fuel is supplied via a fuel pipe 7 to a fuel supply pump 8 that is, for example, a plunger-type variable-capacity high-pressure pump. Fuel-supply pump 8, which is driven by the output of the engine, raises the fuel pressure to a required predetermined pressure, and supplies the fuel to common rails 2 via fuel pipe 9 and pressure-control valve 11. A pressure control valve 11, for maintaining the fuel pressure in common rails 2 at a predetermined pressure, is disposed at the outlet of fuel supply pump 8 and before common rails 2. Fuel, which is relieved from fuel supply pump 8, returns to fuel tank 4 via return pipe 12. Fuel in common rails 2 is supplied to a plurality (six) of injectors 10 (only one is shown) via a fuel supply pipe 3. Of the fuel supplied from fuel supply pipe 3 to injectors 10, the portion that is not used in the injection to the combustion chamber, and the portion that is relieved using pressure control valve 11, returns to fuel tank 4 via return pipes 13, 14.

Signals are input to controller 15, which is an electronic control unit, from a variety of sensors 16 that serve to detect the engine running state, such as an engine cylinder discrimination sensor, a crank angle sensor for detecting the engine rotation speed Ne and top dead center (TDC), an accelerator opening sensor for detecting the accelerator pedal depression amount Ac, a water temperature sensor for detecting the cooling water temperature, and an intake pipe pressure sensor for detecting the pressure in an intake pipe. The pressure of common rails 2 is provided by pressure sensors 18, which are provided in pressure control valve 11. A detection signal for fuel pressure Pr in common rails 2 (herein below termed "common rail pressure"), which is detected by pressure sensors 18, is also input to controller 15. Based on these signals, controller 15 controls conditions of the fuel injection by injector 10 such as the period of the fuel injection (fuel start time and duration) and the injection quantity, and so forth, of injector 10, such that the engine output is optimized to suit the running state of the engine. Fuel inside common rails 2 is consumed by injecting fuel from injectors 10, and the fuel pressure in the common rails is therefore lowered. However, controller 15 performs control such that common rail pressure Pr becomes constant or is the fuel injection pressure required according to the engine running state, by controlling the fuel pressure supplied from fuel supply pump 8 under pressurized conditions by means of a control portion 19 of pressure control valve 11.

FIG. 4 is a vertical cross-sectional schematic view showing one example of an injector that may be used in a common rail fuel injection system. This injector 10 is mounted in a hermetically sealed fashion by means of a seal member in a hole portion provided in a base of a cylinder head, or the like, of which illustration has been omitted from the diagram. Fuel supply pipe 3 is connected to an upper side portion of injector 10, and fuel supply pipe 3 constitutes, along with fuel passages 21, 22, which are formed inside injector 10 proper, a fuel flow pass. With nozzle holes 25 being formed in the front end portion of injector 10, fuel, which is supplied via the fuel flow pass, passes along the passage in the vicinity of a fuel reservoir 23 and a needle valve 24, and, when nozzle holes 25 open when needle valve 24 is lifted, fuel is injected into the combustion chamber from nozzle holes 25.

A pressure-control-chamber type needle-valve lift mechanism is provided in injector 10 in order to control the lifting of needle valve 24. An electromagnetic actuator 26 is provided for driving an electromagnetic valve at the uppermost portion of injector 10. A control current, which corresponds to a command pulse from controller 15, is sent via a signal wire 27 to solenoids 28 of electromagnetic actuator 26. When solenoids 28 are excited, an armature 29 rises, and a switch valve 32 opens, this switch valve being provided at the end portion of discharge path 31. Consequently, fuel pressure, under whose action fuel is supplied from the fuel flow pass to a pressure control chamber 30, is released via discharge path 31. A control piston 34 capable of rising and falling is provided inside a hollow cavity 33 provided inside injector 10 proper. A force, which forces control piston 34 upward, based on fuel pressure acting on a tapered face 36 that faces fuel reservoir 23, is greater than a downward force that works against control piston 34 in accordance with a force that is based on the reduced pressure inside pressure control chamber 30 and with a spring force of a return spring 35. Consequently, control piston 34 rises. As a result, needle valve 24 lifts, and fuel is injected from nozzle holes 25. The time of fuel injection is established by the time of lift of needle valve 24, and the fuel injection quantity is established by fuel pressure in the fuel flow pass and by the lift of needle valve 24 (lift quantity and lift duration). In other words, needle valve 24 rises and falls based on the action of fuel pressure inside pressure control chamber 30, and open/close valve 32 releases fuel pressure inside pressure control chamber 30 by discharging fuel that is inside pressure control chamber 30. The fuel that is discharged via discharge path 31 and the fuel that leaks into hollow cavity 33 and is discharged to a low-pressure path 37, is returned to fuel tank 4 via leak passage 38 and return pipe 13 (FIG. 3).

Generally, the relationship between the quantity of fuel injected by injectors 10 and the pulse width of the command pulse output by controller 15 is established by the use of a map of parameters for common rail pressure Pr (fuel pressure in common rails 2). When common rail pressure Pr is constant, the greater the pulse width, the greater the fuel injection quantity, and if the pulse width is the same, the greater the common rail pressure Pr, the greater the fuel injection quantity. Meanwhile, fuel injection is initiated or stopped in conjunction with a respective time delay with respect to both an instant at which the command pulse is falling and also an instant at which the command pulse is rising. Therefore, since the command pulse controls the on and off timing of fuel injection, it becomes possible to control the injection timing and fuel injection quantity. By pre-providing a base fuel injection quantity characteristic map of the fixed relationship between the base fuel injection quantity and engine rotation speed, with the acceleration pedal depression amount taken as the parameter thereof, the fuel injection quantity for each combustion cycle may be determined by calculating the fuel injectionn quantity, according to the engine running state, from a base fuel injectionn amount characteristic map.

A fall in common rail pressure Pr begins, in conjunction with a time lag from the initiation of fuel injection, and in accordance with fuel injection, for each cylinder, in the engine cycle. When fuel injection is complete, a combustion step proceeds, following which a cycle is repeated for the recovery of fuel in accordance with the discharge of fuel from fuel supply pump 8 for fuel injection into cylinders in which combustion is performed. The engine is a multiple-cylinder engine as shown in FIG. 3, and controller 15 performs control of fuel injection from injectors 10 for each separate cylinder.

In a common rail fuel injection device, while the engine is running, the common rails and the fuel supply path from the common rails to the injectors is kept at high pressure by high-pressure fuel supplied from the fuel supply pump under pressurized conditions, but, when the engine stops, the fuel pressure in the fuel supply path is reduced. When the fuel pressure is reduced, the fuel fill density in the fuel supply path is reduced, and therefore air is entrained as a result of appearance of air, which has been absorbed by the fuel. When the engine is started once again with air entrained with the fuel in this way, a problem arises in that appropriate fuel injection cannot be performed until the extraction of this air from the fuel is complete.

Examples of such an engine fuel supply device that perform the extraction of air from within the fuel in the fuel supply path, in the manner described above, are disclosed in Japanese Patent Application Laid-Open Nos. H6-129325 and H8-193551. In the fuel supply device disclosed in Japanese Patent Application Laid-Open No. H6-129325, a connection is provided, through an aperture, between a delivery pipe, by means of which fuel is conveyed under pressure from a fuel pump, and a fuel pipe that branches by means of a holder that is upstream of the delivery pipe, and is disposed at the top of the delivery pipe, and a connector, which supplies fuel to at least one injector, is opened at the top of the delivery pipe. This being so, vapor gas is stored in the fuel pipe, whereupon an attempt is made to discharge this vapor gas from injectors via this connector.

In the fuel supply device disclosed in Japanese Patent Application Laid-Open No. H8-193551, in case gas is entrained in the fuel supply path, when fuel injection from the injectors is undertaken, attention is paid to alleviating the quantity by which the fuel pressure in the fuel supply path varies momentarily at the initiation of fuel injection and during the completion thereof. Based on the calculated quantity of variation of the fuel pressure in the fuel supply path, a judgment is made as to whether or not gas is entrained in the fuel supply path. When a judgment is made that gas is entrained in the fuel supply path, the number of fuel injection valves that are open at the same time is increased, and the extent of the reduction of fuel pressure in the fuel supply path is thus made large, whereby an attempt is made to simplify the discharge of gas in the fuel supply path via the fuel injection valves.

The means of air extraction disclosed in the publications described above performs the discharge of air from injectors (fuel injection valves), and since fuel injection and air discharge, both from fuel injection valves, and air discharge are performed at the same time, and, as a result of the spraying of fuel being interrupted during fuel injection by the presence of air, such a means has an effect on the fuel injection characteristic. Further, the disposition of a pipe to collect air, in addition to common rails, results in a complicated constitution with an increased number of components and higher manufacturing costs.

In a case in which high-pressure fuel is conveyed under pressure from a fuel supply pump to the common rails, and the fuel pressure in the common rails does not rise to or above a predetermined pressure, there is a high possibility of air being entrained in the fuel supply path comprising the common rails. When such a situation arises, when air is extracted by injecting air, which is entrained in the fuel supply path, along with the fuel, into the fuel combustion chamber from nozzle holes in the injectors, this affects the engine combustion characteristic. Therefore, a problem to be resolved is how to perform the discharge of air, entrained with the fuel, from the injectors, whilst avoiding, by whichever means, the effect on the combustion characteristic.

SUMMARY OF THE INVENTION

In a common rail fuel injection device that stores fuel, which has been discharged from a fuel supply pump, under accumulated pressure, in common rails, and injects fuel, which is supplied from common rails, into a combustion chamber from injectors, in accordance with the engine running state, when discharging air entrained with the fuel from injectors, it is an object of the present invention to employ an existing common rail fuel injection device, to which no changes have been made, to provide a common rail fuel injection device that is capable of discharging air, which is entrained with the fuel, from injectors, whilst also avoiding any effect on the fuel combustion characteristic such as that causing the spraying of fuel to be interrupted.

In order to achieve the above-mentioned object, the present invention is constituted as follows. In other words, the present invention relates to a common rail fuel injection device, comprising: common rails rails that store fuel, which has been discharged from a fuel supply pump, under accumulated pressure; pressure sensors, which detect fuel pressure in the above-mentioned common rails; injectors, having: a pressure control chamber, through which a portion of the fuel supplied from the above-mentioned common rails is guided; a needle valve that opens and closes nozzle holes for the injection of fuel into a combustion chamber by rising and falling based on the action of pressure of the fuel in the above-mentioned pressure control chamber; a open/close valve that opens and closes a discharge path, which discharges high pressure fuel in the above-mentioned pressure control chamber in order to control the fuel pressure in the above-mentioned pressure control chamber; and an actuator that actuates the above-mentioned open/close valve; detection means for detecting the engine running state; and a controller that controls the actuation of the above-mentioned actuator in order to control fuel injection from the above-mentioned injectors in accordance with detection signals from the above-mentioned detection means. This common rail fuel injection device is constituted such that the above-mentioned controller responds to the fact that a predetermined pressure, which is set at a value that is no more than the open-valve pressure for performing fuel injection from the above-mentioned injectors, is not reached by the above-mentioned fuel pressure in the common rails, as detected by the above-mentioned pressure sensors at startup of the engine; and the controller causes the actuation of the above-mentioned actuator, the above-mentioned extraction of the air in the common rails from the above-mentioned pressure control chamber via the above-mentioned discharge path being thus effected.

On account of the above-mentioned constitution of the present invention, when the pressure at which fuel injection by the injectors is initiated, in other words, the open-valve pressure is a fuel pressure that permits resistance, to a downward force, on the needle valve which comprises the injectors, that is based on the action of the fuel pressure in the pressure control chamber, and which fuel pressure permits lifting of the needle valve, since the controller opens the open/close valve, through the actuation of the actuator, and air is discharged along with fuel from the pressure control chamber, via the discharge path, out of the injectors (to a leak passage and fuel tank at low pressure), when fuel pressure in the common rails is low such that it does not equal the predetermined pressure, which is set at a value that is no more than the above-mentioned open-valve pressure, entrained air is discharged from the fuel supply path without being injected into the combustion chamber from nozzle holes in the injectors.

The above-mentioned controller responds to the fact that the above-mentioned predetermined pressure has not been reached by the above-mentioned fuel pressure in the common rails after a preset maximum time has elapsed since the above-mentioned initiation of air extraction, and stops actuation of the above-mentioned actuator for the above-mentioned air extraction. In other words, when the predetermined pressure has not been reached by the fuel pressure in the common rails even after the maximum time has elapsed, actuation of the actuator for air extraction is stopped since, apart from the air being entrained with the fuel, it is considered that the common rail pressure is not rising.

The above-mentioned controller responds to the fact that, following the above-mentioned initiation of air extraction, the above-mentioned engine rotation speed rises to or above the rotation speed for the start of combustion, and therefore stops the actuation of the above-mentioned actuator for the above-mentioned air extraction. In other words, when the engine rotation speed rises to or above the rotation speed for the start of combustion, since the engine has reached a rotation speed at which engine rotation then takes place under the engine's own power, as a result of the injection of fuel and combustion thereof, and therefore air extraction is not required, actuation of the actuator for air extraction is stopped.

Also in a case where the above-mentioned predetermined pressure has not been reached by the above-mentioned fuel pressure in the common rails, the above-mentioned controller is preferably constituted to stop actuation of the above-mentioned actuator for the above-mentioned air extraction until a preset minimum time has elapsed.

The above-mentioned controller preferably outputs a command pulse to the above-mentioned actuator at the time of the above-mentioned air extraction, the pulse width of this command pulse preferably being a fixed value or a value that is elected based on the engine rotation speed.

The above-mentioned actuator is preferably an electromagnetic actuator that comprises solenoids.

The common rail fuel injection device of the present invention is preferably applied to a diesel engine.

Furthermore, the present invention relates to a common rail fuel-injection device comprising: common rails that store fuel under accumulated pressure; pressure sensors, which detect fuel pressure in the above-mentioned common rails; injectors, which inject fuel supplied from the above-mentioned common rails into a combustion chamber; and a controller that controls the above-mentioned injectors in accordance with the engine running state, wherein the above-mentioned injectors comprise a needle valve that opens and closes nozzle holes; a spring that serves to urge the above-mentioned needle valve in the closing direction thereof; a fuel reservoir, into which the fuel of the above-mentioned common rails is guided and which provides fuel pressure in the opening direction of the above-mentioned needle valve; a pressure control chamber, into which the fuel of the above-mentioned common rails is guided and which provides fuel pressure in the closing direction of the above-mentioned needle valve; a discharge path for leakage of fuel from the above-mentioned pressure control chamber; a open/close valve for opening and closing the above-mentioned discharge path; and an actuator that actuates the above-mentioned open/close valve on the basis of control signals from the above-mentioned controller; in which injectors the above-mentioned needle valve is opened and closed by the balance of the forces generated by the above-mentioned spring force, the above-mentioned fuel pressure of the above-mentioned fuel reservoir and the above-mentioned fuel pressure of the above-mentioned pressure control chamber, and wherein, in a case where, at engine startup, the fuel pressure, in the common rails, which is detected by the above-mentioned pressure sensors, does not reach a predetermined pressure that is set at a value that is no more than the open-valve pressure of the above-mentioned injectors, fuel is caused to leak from the above-mentioned pressure control chamber via the above-mentioned discharge path by actuating the above-mentioned actuator, and the above-mentioned extraction of the air in the common rails is performed, not accompanied by fuel injection.

When a state, in which the above-mentioned fuel pressure in the common rails does not reach the above-mentioned predetermined pressure, continues beyond a predetermined minimum time, it is preferable for the above-mentioned extraction of the air in the common rails to be undertaken.

When the state, in which the above-mentioned fuel pressure in the common rails does not reach the above-mentioned predetermined pressure, continues such that a predetermined maximum time, which is longer than the above-mentioned minimum time, is exceeded, it is preferable to stop the above-mentioned extraction of the air in the common rails.

When the engine rotation speed exceeds the predetermined rotation speed for the start of combustion, it is preferable to stop the above-mentioned extraction of the air in the common rails.

The above-mentioned controller outputs a command pulse to the above-mentioned actuator at the time of the above-mentioned air extraction, and it is preferable for the pulse width of this command pulse to be a fixed value or a value that is elected based on the engine rotation speed.

The above-mentioned actuator is preferably an electromagnetic actuator that comprises solenoids.

This common rail fuel injection device is preferably applied to a diesel engine.

Furthermore, The present invention relates to a method of controlling the extraction of air in common rails, comprising: common rails that store fuel, which has been discharged from a fuel supply pump, under accumulated pressure; pressure sensors, which detect fuel pressure in the above-mentioned common rails; injectors, having: a pressure control chamber, through which a portion of the fuel supplied from the above-mentioned common rails is guided; a needle valve that opens and closes nozzle holes for the injection of fuel into a combustion chamber by rising and falling based on operation of pressure of fuel in the above-mentioned pressure control chamber; a open/close valve that opens and closes a discharge path, which discharges high pressure fuel in the above-mentioned pressure control chamber in order to control the fuel pressure in the above-mentioned pressure control chamber; and an actuator that actuates the above-mentioned open/close valve; the present invention further comprises detection means for detecting the engine running state; and a controller that controls the actuation of the above-mentioned actuator in order to control fuel injection from the above-mentioned injectors in accordance with detection signals from the above-mentioned detection means, wherein, in response to the fact that a predetermined pressure, which is set at a value that is no more than the open-valve pressure for performing fuel injection from the above-mentioned injectors, is not reached by the above-mentioned fuel pressure in the common rails, as detected by the above-mentioned pressure sensors at startup of the engine; the actuation of the above-mentioned actuator is caused by the controller so that fuel is thus caused to leak from the above-mentioned pressure control chamber via the above-mentioned discharge path, and the above-mentioned extraction of the air in the common rails is thus effected.

It is preferable that, in response to the fact that the above-mentioned predetermined pressure has not been reached by the above-mentioned fuel pressure in the common rails after a preset maximum time has elapsed since the above-mentioned initiation of air extraction, the actuation of the above-mentioned actuator for the above-mentioned air extraction is stopped by the above-mentioned controller.

It is preferable that, in response to the fact that, following the above-mentioned initiation of air extraction, the above-mentioned engine rotation speed rises to or above the rotation speed for the start of combustion, the actuation of the above-mentioned actuator for the above-mentioned air extraction is stopped by the above-mentioned controller.

Also even in a case where the above-mentioned predetermined pressure has not been reached by the above-mentioned fuel pressure in the common rails, it is preferable for actuation of the above-mentioned actuator for the above-mentioned air extraction to be stopped by the above-mentioned controller until a preset minimum time has elapsed.

The above-mentioned controller outputs a command pulse to the above-mentioned actuator at the time of the above-mentioned air extraction, the pulse width of this command pulse preferably being a fixed value or a value that is elected based on the engine rotation speed.

The method, according to the present invention, of controlling the extraction of air in the common rails is preferably applied to a diesel engine.

DETAILED DESCRIPTION OF THE INVENTION

Figure 1:
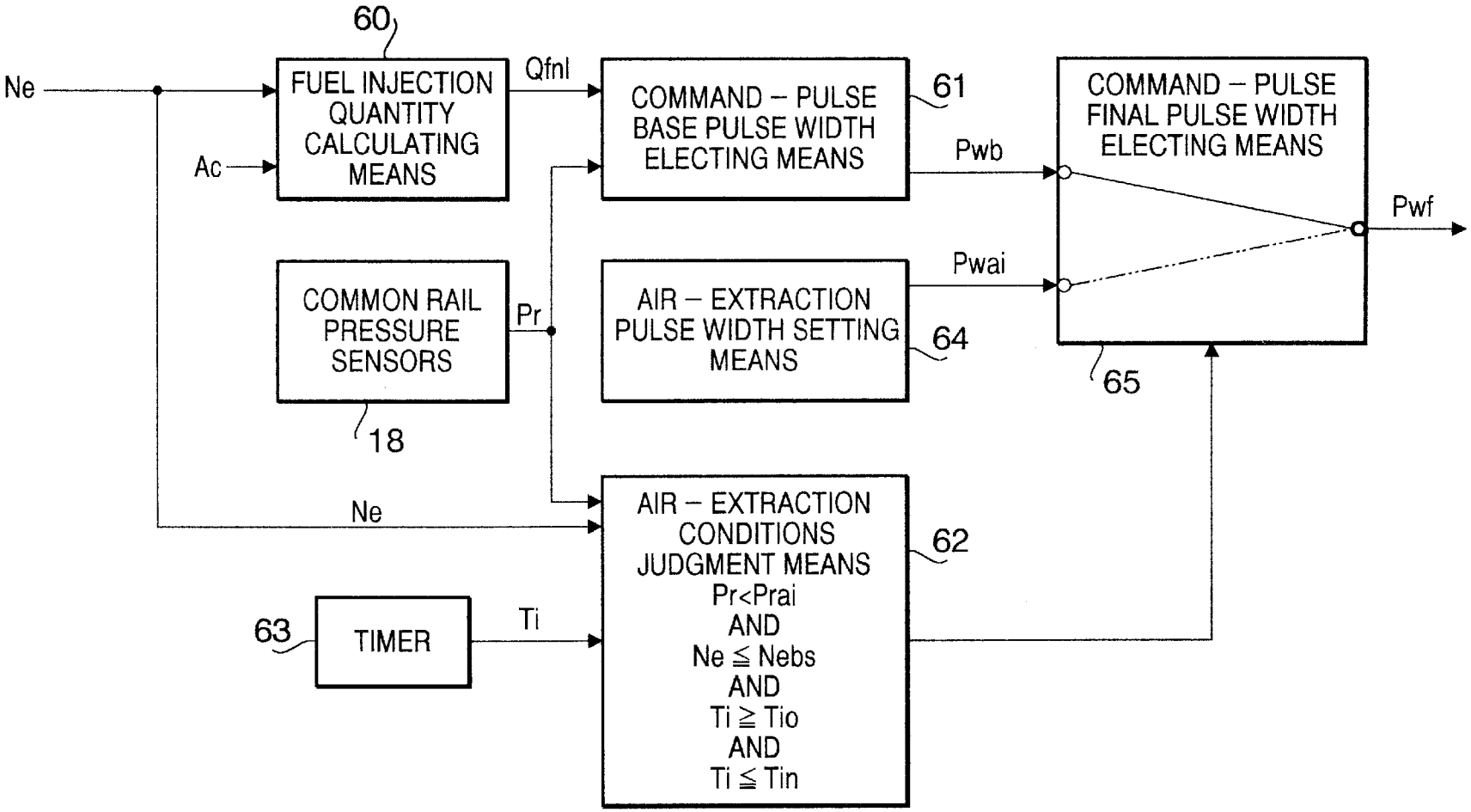
FIG. 1 is a block diagram showing an example of a controller of the common rail fuel injection device according to the present invention.
Figure 2:
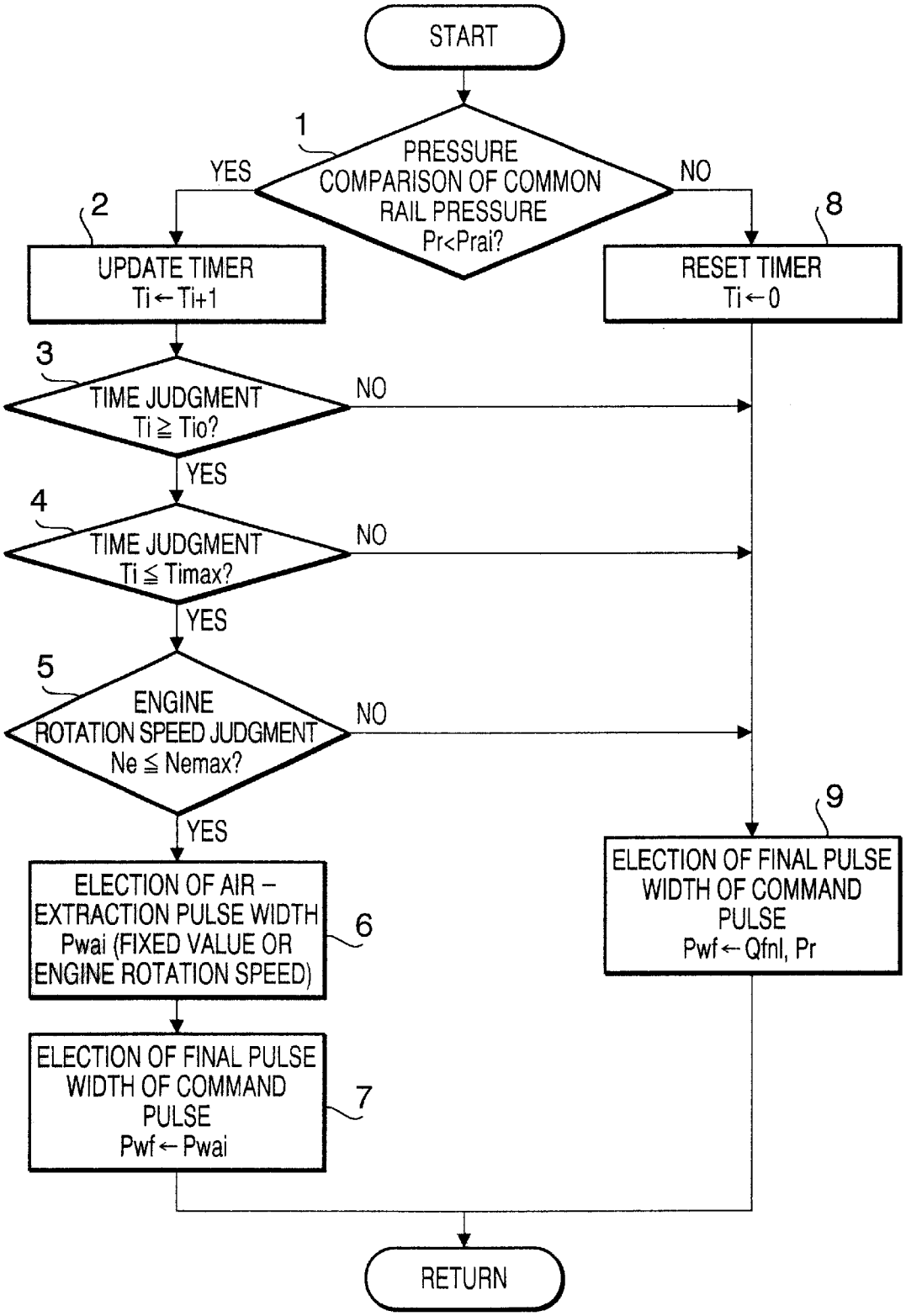
FIG. 2 is a flow chart showing an example of the control flow, for undertaking air extraction using the common rail fuel injection device shown in FIG. 1.
Figure 3:
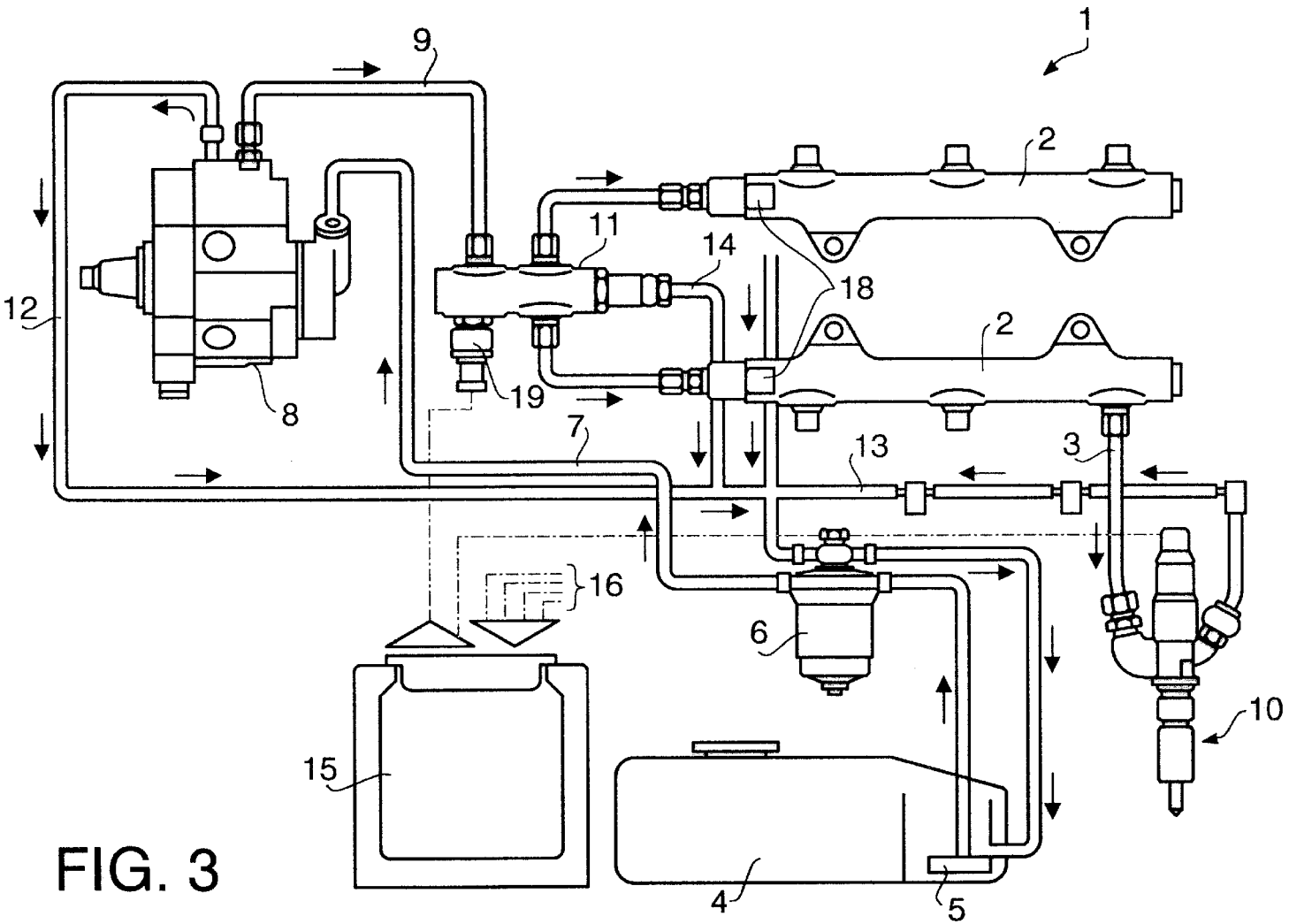
FIG. 3 is a schematic diagram of an example of a common rail fuel injection system, in which a common rail fuel injection device according to the present invention is applied.

A present embodiment of a common rail fuel injection device according to the present invention is described herein below by reference to the drawings. FIG. 1 is a block diagram showing an example of a controller of the common rail fuel injection device according to the present invention; FIG. 2 is a flow chart showing an example of the control flow, for undertaking the discharge of entrained air, by the common rail fuel injection device according to the present invention.

Controller 15 shown in FIG. 1 comprises a fuel injection quantity calculating means 60, which calculates a fuel injection quantity Qfnl based on an engine rotation speed Ne, and an accelerator actuation amount Ac such as an accelerator depression amount; and a base pulse width electing means 61 that elects a base pulse width Pwb of the command pulse for undertaking fuel injection from injectors 10, based on fuel injection quantity Qfnl, and of common rail pressure Pr, which is detected by pressure sensors 18 disposed on common rails 2. Air extraction conditions judgment means 62 receives inputs of, common rail pressure Pr, which is detected by pressure sensors 18, engine rotation speed Ne, and a count value Ti of a timer 63, and thus makes a judgment as to whether or not all of the conditions for performing air extraction have been fulfilled. In other words, air-extraction conditions judgment means 62 compares common rail pressure Pr, which is detected by pressure sensors 18, and a predetermined pressure Prai set at a value that is no more than the open-valve pressure, and thus makes a judgment as to whether or not common rail pressure Pr is lower than predetermined pressure Prai; and air-extraction conditions judgment means 62 compares engine rotation speed Ne and a rotation speed for the start of combustion Nebs, and thus makes a judgment as to whether or not engine rotation speed Ne is no more than rotation speed for the start of combustion Nebs; air-extraction conditions judgment means 62 further compares count value Ti, of timer 63, and minimum time $Ti_0$, and thus makes a judgment as to whether or not count value Ti is equal to or more than minimum time $Ti_0$ and also compares count value Ti and a maximum time Tiu to make a judgment as to whether or not count value Ti is less than maximum time Tiu.

Only when common rail pressure Pr is lower than predetermined pressure Prai, when engine rotation speed Ne is no more than rotation speed for the start of combustion Nebs, and when count value Ti of timer 63 is equal to or more than minimum time $Ti_0$ and is no more than maximum time Tiu, does air-extraction conditions judgment means 62 make an output to command-pulse final pulse width electing means. In a case where count value Ti is lower than minimum time $Ti_0$, air extraction conditions judgment means 62 waits for common rail pressure Pr to rise, until count value Ti is equal to or more than minimum time $Ti_0$. The reason for limiting count value Ti to maximum time Tiu is that, in a case where common rail pressure Pr has not risen to a pressure that is equal to or more than a predetermined pressure during cranking of the engine, even after a long period has elapsed, it is considered that there has been an unintentional leakage of fuel from the injectors into the cylinders. Leakage of fuel in the cylinders during cranking of the engine causes fuel hammer to be produced at the start of combustion. When a judgment has been made by air-extraction conditions judgment means 62 that all of the conditions for the above-mentioned common rail pressure Pr, engine rotation speed and time elapsed have been completely satisfied, air-extraction conditions judgment means 62 outputs a signal to command-pulse final pulse width electing means 65, and elects an air-extraction pulse width Pwai, which is set by air-extraction pulse width setting means 64, as the final pulse width, in place of base pulse width Pwb, which is output by base pulse width electing means 61.

Figure 4:
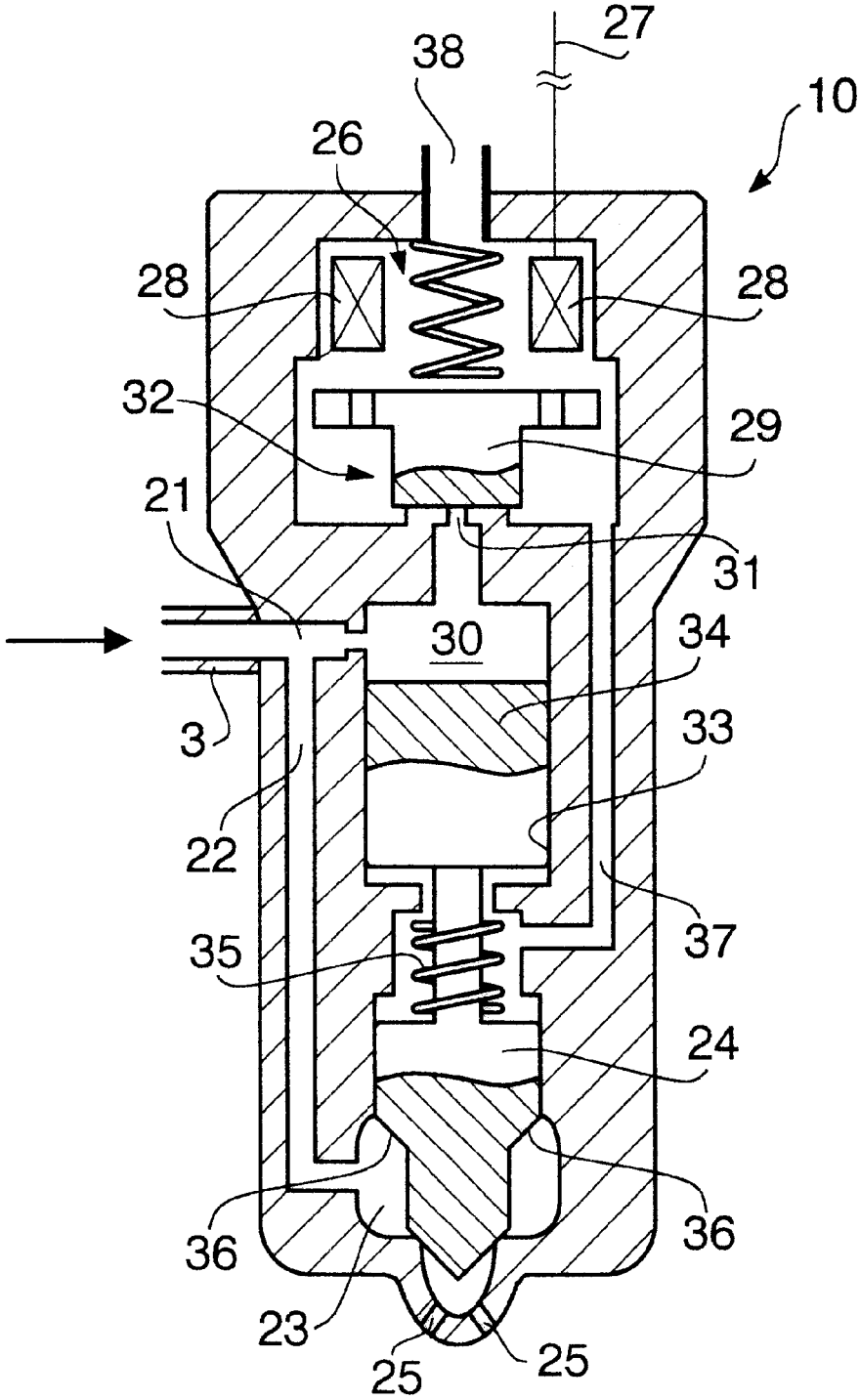
FIG. 4 is a cross-sectional schematic diagram showing an example of an injector that may be employed in the common rail fuel injection system shown in FIG. 3.

With regard to air-extraction control by a common rail fuel injection device, one example of the control flow for undertaking air extraction will be described herein below based on the flow chart shown in FIG. 2. First, a pressure comparison between common rail pressure Pr and predetermined pressure Prai is performed (step 1). Predetermined pressure Prai is set as a pressure, which is no more than the open-valve pressure that does not rise any further should air be entrained with the fuel. When the outcome of the judgment of step 1 is "NO", since common rail pressure Pr has risen to a favorable level, timer 63 (FIG. 1) is reset and count value Ti is substituted with 0 (step 8). A command-pulse final pulse width Pwf for the output of a drive current to actuator 26 of injector 10 (FIG. 4) is normally elected for base pulse width Pwb by base pulse width electing means 61 based on fuel injection quantity Qfnl and common rail pressure Pr (step 9).

When the result of the comparison of pressures in step 1 is "YES", count value Ti of timer 63 is updated by 1 (step 2). Further, a judgment is made as to whether or not count value Ti is equal to or more than minimum time $Ti_0$ (step 3). When count value Ti is equal to or exceeds minimum time $Ti_0$, a judgment is made as to whether or not count value Ti is no more than maximum time Tiu (step 4). Grounds for providing minimum time $Ti_0$ and maximum time Tiu for count value Ti are as per the description for air-extraction conditions judgment means 62. In particular, when the control of air extraction is continued even when count value Ti exceeds maximum time Tiu, it is considered that another factor is causing common rail pressure Pr not to rise, and air-extraction control is stopped. If any of the judgment results in any of steps 3 to 5 is "NO", the control flow proceeds to step 9 and base pulse width Pwb, which is elected by command pulse base pulse width electing means 61, is elected as final pulse width Pwf.

When the time judgments of steps 3 and 4 yield a "YES", a rotation speed judgment is performed as to whether or not engine rotation speed Ne is no more than rotation speed for the start of combustion Nebs (step 5). When the judgment of step 5 yields a "YES", air-extraction pulse width Pwai, which is set by air-extraction pulse width setting means 64, is elected as the pulse width of the command pulse based on a fixed value or the engine rotation speed (step 6). Further, air-extraction pulse width Pwai is elected as final pulse width Pwf. Actuator 26 of injector 10 is actuated based on final pulse width Pwf, in other words, air-extraction pulse width Pwai.

Since, at the very start of actuation of actuator 26 for air extraction, common rail pressure Pr is lower than predetermined pressure Prai, the needle valve 24 of injector 10 (FIG. 4) is not lifted under the action of fuel pressure in fuel reservoir 23. However, when open/close valve 32 opens as a result of actuation of actuator 26, air, which is entrained in the fuel supply path from common rails 2 to injector 10, is discharged along with fuel out of the low-pressure side of injector 10, via pressure control chamber 30, discharge path 31 and leak passage 38. Fuel is thus returned to fuel tank 4. In addition to air extraction then taking place, common rail pressure Pr then begins to rise.

While air extraction is taking place, when, in the rotation judgment in step 5, engine rotation speed Ne exceeds rotation speed for the start of combustion Nebs, although common rail pressure Pr is neither equal to nor greater than predetermined pressure Prai, engine rotation speed Ne is achieved under the engine's own power. In other words, engine rotation speed Ne is reached at which rotation begins as a result of the combustion of fuel that is injected from injectors 10. Since the assumption is made that common rail pressure Pr will soon rise to a satisfactory level, air-extraction control is stopped, the control flow proceeds to step 9, and base pulse width Pwb, which is elected by command-pulse base pulse-width electing means 61 is elected as final pulse width Pwf.

With the common rail fuel injection device according to the present invention, since a response is made to the fact that the fuel pressure in the common rails, which is detected by the pressure sensors, does not reach the predetermined pressure that is no more than the open-valve pressure for performing fuel injection from the injectors, and the actuator is then actuated for air extraction, the air, which is entrained with the fuel in the fuel supply path from the common rails to the injectors, is discharged out of the injectors, along with fuel, from the pressure control chamber, via the discharge path and the leak passage. In other words, with this common rail fuel injection device, the spraying of fuel is not interrupted, as is the case when air extraction is effected by injecting air, along with fuel, from nozzle holes in the injectors into the cylinders, and a situation where such air extraction may have an effect on the combustion characteristic can be thus avoided. Further, with this common rail fuel injection device, neither special device nor construction is required, since air, which has been entrained with fuel, can be discharged from the injectors by adopting an existing common rail fuel injection device to which no changes have been made.

What is claimed is:

1. A common rail fuel injection device, comprising:

common rails that store fuel, which has been discharged from a fuel supply pump, under accumulated pressure;

pressure sensors, which detect fuel pressure in said common rails;

injectors, having:

a pressure control chamber, through which a portion of the fuel supplied from said common rails is guided;

a needle valve that opens and closes nozzle holes for the injection of fuel into a combustion chamber by rising and falling based on the action of pressure of the fuel in said pressure control chamber;

a open/close valve that opens and closes a discharge path, which discharges high pressure fuel in said pressure control chamber in order to control the fuel pressure in said pressure control chamber; and an actuator that actuates said open/close valve;

detection means for detecting an engine running state; and a controller that controls actuation of said actuator in order to control fuel injection from said injectors in accordance with detection signals from said detection means;

wherein said controller responds to the fact that a predetermined pressure, which is set at a value that is no more than the open-valve pressure for performing fuel injection from said injectors, is not reached by said fuel pressure in the common rails, as detected by said pressure sensors at startup of the engine, and causes the actuation of said actuator, so that extraction of air in said common rails from said pressure control chamber via said discharge path is thus effected.

2. The common rail fuel injection device according to claim 1, wherein said controller responds to the fact that said predetermined pressure has not been reached by said fuel pressure in the common rails after a preset maximum time has elapsed since said initiation of air extraction, and stops actuation of said actuator for said air extraction.

3. The common rail fuel injection device according to claim 1, wherein said controller responds to the fact that, following said initiation of air extraction, said engine rotation speed rises to or above the rotation speed for the start of combustion, and therefore stops the actuation of said actuator for said air extraction.

4. The common rail fuel injection device according to claim 1, wherein, also in a case where said predetermined pressure has not been reached by said fuel pressure in the common rails, said controller stops actuation of said actuator for said air extraction until a preset minimum time has elapsed.

5. The common rail fuel injection device according to claim 1, wherein said controller outputs a command pulse to said actuator at the time of said air extraction, the pulse width of this command pulse being a value that is elected based on a fixed value or the engine rotation speed.

6. The common rail fuel injection device according to claim 1, wherein said actuator is an electromagnetic actuator that comprises solenoids.

7. The common rail fuel injection device according to claim 1, wherein the common rail fuel injection device is applied to a diesel engine.

8. A common rail fuel injection device, comprising:

common rails that store fuel under accumulated pressure;

pressure sensors, which detect fuel pressure in said common rails;

injectors, which inject fuel supplied from said common rails into a combustion chamber; and a controller that controls said injectors in accordance with the engine running state, wherein said injectors are equipped with a needle valve that opens and closes nozzle holes;

a spring that serves to urge said needle valve in a closing direction thereof;

a fuel reservoir, into which the fuel of said common rails is guided and which provides fuel pressure in an opening direction of said needle valve;

a pressure control chamber, into which the fuel of said common rails is guided and which provides fuel pressure in a closing direction of said needle valve;

a discharge path for leakage of fuel from said pressure control chamber;

a open/close valve for opening and closing said discharge path; and an actuator that actuates said open/close valve based on control signals from said controller; and in which injectors said needle valve is opened and closed by the balance of the forces generated by said spring force, said fuel pressure of said fuel reservoir, and said fuel pressure of said pressure control chamber; and wherein, in a case where, at engine startup, the fuel pressure, in the common rails, which is detected by said pressure sensors, does not reach a predetermined pressure that is set at a value that is no more than the open-valve pressure of said injectors, fuel is caused to leak from said pressure control chamber via said discharge path by actuating said actuator, and said extraction of the air in the common rails is performed, not accompanied by fuel injection.

9. The common rail fuel injection device according to claim 8, wherein, when a state, in which said fuel pressure in the common rails does not reach said predetermined pressure, continues beyond a predetermined minimum time, said extraction of the air in the common rails is undertaken.

10. The common rail fuel injection device according to claim 9, wherein, when a state, in which said fuel pressure in the common rails does not reach said predetermined pressure, continues such that a predetermined maximum time, which is longer than said minimum time, is exceeded, said extraction of the air in the common rails is stopped.

11. The common rail fuel injection device according to claim 10, wherein, when the engine rotation speed exceeds the predetermined rotation speed for the start of combustion, said extraction of the air in the common rails is stopped.

12. The common rail fuel injection device according to claim 8, wherein said controller outputs a command pulse to said actuator at the time of said air extraction, and the pulse width of this command pulse is a value that is elected based on a fixed value or the engine rotation speed.

13. The common rail fuel injection device according to claim 8, wherein said actuator is an electromagnetic actuator that comprises solenoids.

14. The common rail fuel injection device according to claim 8, wherein the common rail fuel injection device is applied to a diesel engine.

15. A method of controlling the extraction of air in common rails, in a common rail fuel injection device, the method comprising the steps of:

storing fuel in Common rails, the stored fuel has been discharged from a fuel supply pump, under accumulated pressure;

detecting fuel pressure in said common rails with pressure sensors;

guiding a portion of the fuel supplied from said common rails through a pressure control chamber of injectors, the injectors further having a needle valve that opens and closes nozzle holes for the injection of fuel into a combustion chamber by rising and falling based on the action of pressure of fuel in said pressure control chamber; an open/close valve that opens and closes a discharge path, which discharges high pressure fuel in said pressure control chamber in order to control the fuel pressure in said pressure control chamber; and an actuator that actuates said open/close valve;

detecting an engine running state with detection means; and controlling actuation of said actuator with a controller in order to control fuel injection from said injectors in accordance with detection signals from said detection means;

wherein, in response to the fact that a predetermined pressure, which is set at a value that is no more than the open-valve pressure for performing fuel injection from said injectors, is not reached by said fuel pressure in the common rails, as detected by said pressure sensors at startup of the engine, the actuation of said actuator is caused by means of said controller, so that fuel is thus caused to leak from said pressure control chamber via said discharge path, and extraction of air in said common rails is thus effected.

16. The method of controlling the extraction of air in common rails according to claim 15, wherein, in response to the fact that said predetermined pressure has not been reached by said fuel pressure in the common rails after a preset maximum time has elapsed since said initiation of air extraction, actuation of said actuator for said air extraction is stopped by the controller.

17. The method of controlling the extraction of air in common rails according to claim 15, wherein, in response to the fact that, following said initiation of air extraction, said engine rotation speed rises to or above the rotation speed for the start of combustion, actuation of said actuator for said air extraction is stopped by the controller.

18. The method of controlling the extraction of air in common rails according to claim 15, wherein, also in a case where said predetermined pressure has not been reached by said fuel pressure in the common rails, actuation of said actuator for said air extraction is stopped by said controller until a preset minimum time has elapsed.

19. The method of controlling the extraction of air in common rails according to claim 15, wherein said controller outputs a command pulse to said actuator at the time of said air extraction, the pulse width of this command pulse being a value that is elected on the basis of a fixed value or the engine rotation speed.

20. The method of controlling the extraction of air in common rails according to claim 15, wherein, the method of controlling the extraction of air in common rails is applied to a diesel engine.

* * * * *